US005516024A

United States Patent [19]

Hohner et al.

[11] Patent Number: 5,516,024

[45] Date of Patent: May 14, 1996

[54] STAPLING HEAD FOR A STAPLING MACHINE

[75] Inventors: Claus O. Hohner, Tuttlingen; Egbert Karrer, Allensbach, both of Germany

[73] Assignee: Hohner Maschinenbau GmbH, Tuttlingen, Germany

[21] Appl. No.: 366,302

[22] Filed: Dec. 29, 1994

[30] Foreign Application Priority Data

Dec. 30, 1993 [DE] Germany ..... 43 44 999.9

[51] Int. Cl.[6] ..... B27F 7/30

[52] U.S. Cl. ..... 227/089; 227/90

[58] Field of Search ..... 227/89, 90, 91, 227/87, 88, 152, 153, 129

[56] References Cited

U.S. PATENT DOCUMENTS

| | | | |
|---|---|---|---|
| 1,053,196 | 2/1913 | Messersmith | 227/89 |
| 1,226,170 | 5/1917 | Baamann | 227/89 |
| 1,255,201 | 2/1918 | Maynard . | |
| 2,716,748 | 9/1955 | Sutton | 227/89 |
| 2,865,021 | 12/1958 | Marzili | 227/89 |
| 2,896,214 | 7/1959 | Wright | 227/89 |

FOREIGN PATENT DOCUMENTS

| | | |
|---|---|---|
| 406410 | 11/1924 | Germany . |
| 3221067 | 12/1983 | Germany . |
| 3640529 | 6/1988 | Germany . |

*Primary Examiner*—Scott A. Smith
*Attorney, Agent, or Firm*—Spencer & Frank

[57] ABSTRACT

So that a staple driver does not perform a movement relative to a staple holder until the staple holder comes down on the material to be stapled, provision is made according to the invention for the staple holder and the staple driver of a stapling head to be driven by a common drive device via a cam control mechanism. The cam control mechanism has a cam plate which is made to perform a stroke movement via a drive pin on which it is rotatably mounted. The staple holder and staple driver are driven by two connecting rods which relative to the rotation axis act eccentrically on two sides on the cam plate. A stationary guide rail, against which the cam plate is supported with a guide surface during a first phase of the working stroke, prevents a rotary movement of the cam plate during the first phase of the working stroke and thereby fixes the staple driver relative to the staple holder.

10 Claims, 1 Drawing Sheet

STAPLING HEAD FOR A STAPLING MACHINE

BACKGROUND OF THE INVENTION

The invention relates to a stapling head operable during a working stroke to staple piled sheets of paper using wire staples. The stapling head includes a frame, and a staple holder guided in the frame that is displaceable in a working direction essentially perpendicular to the sheets of paper. A staple driver is guided on the staple holder, and is displaceable in the working direction. Driving means are provided for moving the staple holder and the staple driver in the working direction during a first phase of the working stroke, so that the staple holder is moved onto the piled sheets, and is stopped at the piled sheets at an end of the first phase. The driving means move the staple driver further in the working direction to drive a wire staple out of the staple holder and into the piled sheets during a second phase of the working stroke. The driving means move the staple driver and the staple holder back into their initial positions during an idle stroke.

DE 3640529 A1 discloses a stapling head of this type. To drive a staple driver, the known stapling head has a crank and lever mechanism. To drive a staple holder, a crank and lever mechanism is provided with an additional superimposed transmission device. The purpose of this complicated drive is for the legs of a wire staple to be driven only slightly out of its guide in the staple holder before the staple holder comes down on the material to be stapled. The staple legs, at the start of the driving into the material to be stapled, are thereby guided over a large part of their length in the staple holder; this is intended to avoid distortion of the wire staple.

A disadvantage of the known stapling head is the complicated construction of the drive. A further disadvantage is that the staple holder comes down only momentarily on the material to be stapled and is lifted again directly afterwards so that the legs of the wire staple are only guided momentarily over their entire length when being pressed into the material to be stapled.

SUMMARY OF THE INVENTION

The object of the invention is to further develop a stapling head of the type mentioned at the beginning in such a way that in particular the mechanical construction is greatly simplified and reliable guidance of the wire staple is guaranteed.

This object is achieved by a stapling head having driving means including a cam plate rotatably mounted in the frame, and that is movable in the working direction. A first connecting rod has one end eccentrically connected to the cam plate, and another end pivotally connected to the staple holder, and is moved by the cam plate in an eccentric direction relative to the working direction. A second connecting rod has one end eccentrically connected to the cam plate, and another end pivotally connected to the staple driver, and is moved by the cam plate in an eccentric direction relative to the working direction. Guide means are provided that include a guide link attached to the frame for supporting and rotationally locking the cam plate to positionally fix the staple driver relative to the staple holder during the first phase, and unlocking the cam plate during the second phase so that the staple driver and the staple holder are not positionally fixed relative to each other.

In the stapling head according to the invention, the staple holder and the staple driver are driven via a cam plate to which they are connected by connecting rods acting eccentrically on it. As a result, the staple holder and the staple driver first of all move together without a movement relative to one another until the staple holder comes down on the material to be stapled. The staple holder then remains on the material to be stapled until the staple driver has driven the wire staple completely into the material to be stapled. The cam plate is rotatably mounted on a drive pin which is located between the points of application of the two connecting rods on the cam plate. The drive pin and thus the cam plate perform a stroke movement parallel to the stroke movement of staple holder and staple driver.

During a first phase of the working stroke running towards the material to be stapled, the cam plate is supported via a type of link guide and in particular with a lateral guide surface on a guide rail, fastened permanently to a stapling head frame and running in the stroke direction, so that it is guided in a rotationally locked manner. The staple driver and the staple holder are thereby held in a mutually fixed manner via the two connecting rods. They accordingly perform their stroke movement together during the first phase of the working stroke.

At the end of the first phase of the working stroke, the staple holder comes down on the material to be stapled and at the same time runs against a stop at the stapling head frame so that its stroke movement is stopped. At the same time, the link guide is disengaged, i.e. the lateral guide surface of the cam plate is released from the guide rail so that the cam plate becomes freely rotatable. While the cam plate is stopped at the point of application of the connecting rod connected to the staple driver on account of the stopped staple driver, the drive pin continues to move so that the cam plate rotates during its further movement; the staple driver is thereby likewise moved further via its connecting rod and the wire staple is driven into the material to be stapled. The staple driver accelerates considerably during the transition from the first phase of the working stroke to the second phase of the working stroke, since the rotary movement of the cam plate is superimposed on the stroke movement of the pin, which during the first phase of the working stroke is identical to the stroke movement of staple driver and staple holder. This leads to a desirable "knocking-in" of the wire staple.

The drive for the staple holder and the staple driver of the stapling head according to the invention is of substantially simpler construction than that of the known stapling head; it is effected by means of a common drive pin. Consequently, separate drives are no longer required for staple holder and staple driver.

A further advantage of the stapling head according to the invention consists in the fact that the staple holder remains at rest on the material to be stapled during the driving-in of the staple and as a result guides the legs of the wire staple.

In order to turn the cam plate back into its initial position during the idle stroke, a restoring rail is provided which in relation to the guide rail is attached on the other side of the cam plate to the head frame and along which a restoring lobe of the cam plate slides. When the cam plate swings back into its initial position, the staple holder and the staple driver connected to the cam plate via the two connecting rods also move into their initial position with respect to one another, so that the movable parts of the stapling head again assume their initial position at the end of the idle stroke.

A preferred development of the invention has a bending device which comprises the staple holder, having two side cheeks arranged at its front end facing the material to be stapled, and a staple former in which a retaining slot is attached transversely to the stroke movement. In the course of the first phase of the working stroke, the two side cheeks of the staple holder move laterally along the staple former and in the process bend over the two laterally projecting ends of a wire section, accommodated in the retaining slot, to form legs of a U-shaped wire staple.

The two side cheeks of the staple holder have guide grooves at their insides facing one another, in which the legs of the wire staple come to lie during the bending. These two guide grooves, in which the wire staple is held by its spring tension, guide the two legs of the wire staple when it is being driven into the material to be stapled.

The wire feed into the retaining slot and the cutting-off of the wire section are effected in a manner known per se by means of a wire-feed device and a wire-cutting device respectively.

The staple former, in the retaining slot of which the yoke of the wire staple is accommodated, is located in the path of the staple driver during the bending of the wire staple. In order to move the staple former out of the path of the staple driver after the wire staple is bent and is held in the guide grooves of the side cheeks of the staple holder, a sloping surface is provided on the staple driver, which sloping surface pushes the staple former out of the path of the staple driver during the further working stroke.

Simultaneously or subsequently, a spring-loaded staple support pivotably fastened to the staple holder pivots between the two side cheeks of the staple holder into the area in which the legs of the wire staple are located. The legs of the wire staple are supported all round by the guide grooves and the staple support and therefore cannot bend to the side. Deformation of the wire staple when being driven into the material to be stapled is virtually impossible.

The staple support likewise has a sloping surface on which the staple driver comes to bear with an end edge when it is displaced relative to the stationary staple holder when the wire staple is being driven into the material to be stapled. In the process, the staple driver continuously pushes the staple support out of its path, which at the same time is the path of the yoke of the wire staple.

The cam plate preferably has a rotary brake, for example in the form of Belleville washer springs, which prevents the cam plate from rotating automatically when it is not guided on the guide rail or the restoring rail.

BRIEF DESCRIPTION OF THE DRAWINGS

The invention is described below with reference to an exemplary embodiment shown in the drawing, in which.

DETAILED DESCRIPTION OF THE INVENTION

Figure 1:
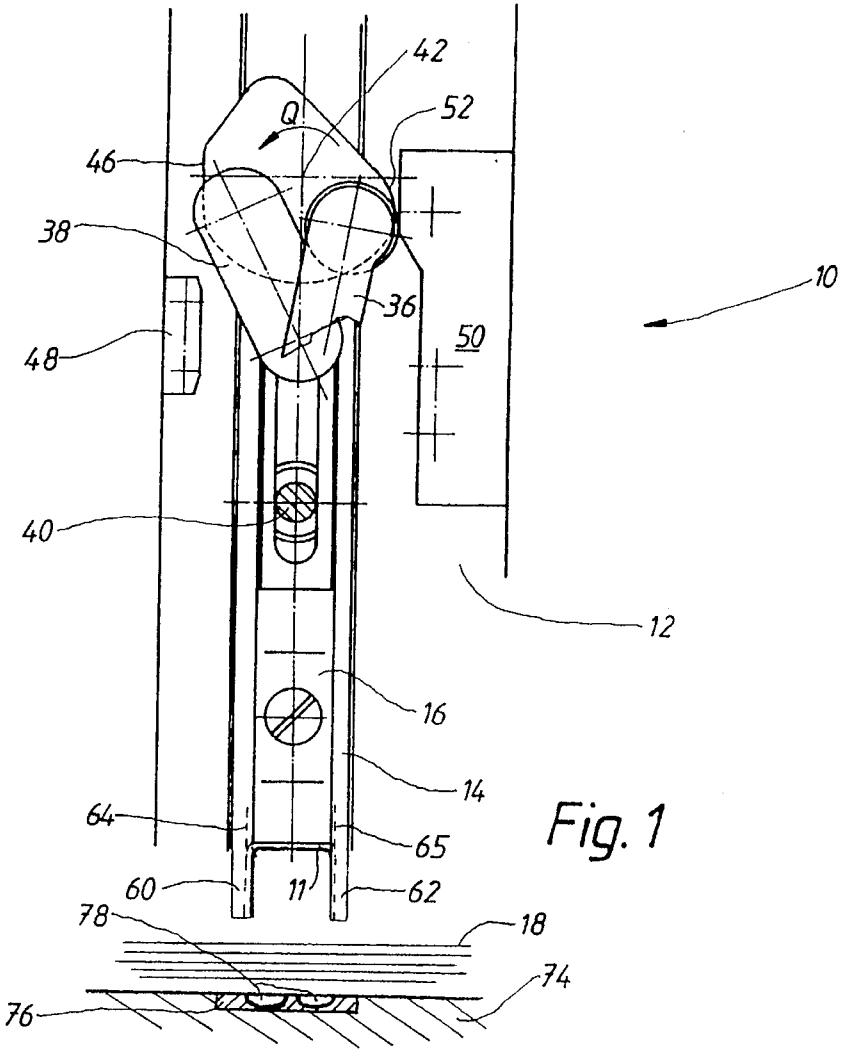
FIG. 1 shows a schematic representation of a stapling head according to the invention in plan view.

The essential parts of a stapling head 10 for stapling piled sheets of paper by means of wire staples 11 are shown in the figures. The stapling head 10 has a head frame 12 (only indicated in the figures). A staple holder 14 is guided in the head frame 12 in a longitudinally displaceable manner by means of a tongue-and-groove guide (not shown). In the staple holder 14, a staple driver 16 is guided in a longitudinally displaceable manner in the same direction by just such a tongue-and-groove guide. The displacing direction of staple holder 14 and staple driver 16 is the stroke direction; the working stroke heads perpendicularly towards the material 18 to be stapled.

On the side of the staple holder 14 and staple driver 16 remote from the material 18 to be stapled, a sliding block 20 is likewise guided in the head frame 12 in a longitudinally displaceable manner in the stroke direction. A drive pin 22 having a tapped hole is pushed rotatably through the sliding block 20 perpendicularly to the stroke direction, onto which drive pin 22 a cam plate 24 is pressed or welded. A disc 26 is screwed with a screw 28 to the other side of the drive pin 22. A washer 30 is put between the cam plate 24 and the sliding block 20, a pair 32 of Belleville springs is put between the disc 26 and the sliding block 20, and a washer 34 is likewise put onto the drive pin 22. The pair 32 of Belleville springs acts with the washers 30, 34 as a rotary friction brake which prevents automatic rotation of the cam plate 24.

The staple holder 14 is connected to the cam plate 24 via a holder connecting rod 36, and the staple driver 16 is connected to the cam plate 24 via a driver connecting rod 38. One end of the holder connecting rod 26 is rotatably and eccentrically fastened to the cam plate 24 by means of a pin (not shown); its other end is rotatably attached to the staple holder 14 via a bolt 40. One end of the driver connecting rod 38 is likewise attached eccentrically and, on the opposite side from the holder connecting rod 36 in relation to the rotation axis 42, rotatably to the cam plate 24 by means of a pin (not shown); a pin 44 connects the other end of the driver connecting rod 38 to the staple driver 16.

The cam plate 24 is provided with a lateral guide surface 46 via which it is supported during the first phase of the working stroke in a rotationally locked manner against a guide rail 48 screwed laterally to the stapling head frame 12. On the opposite side, a restoring rail 50 is screwed to the stapling head frame 12, on which restoring rail 50 a lobe 52 of the cam plate 24 comes to bear during the idle stroke.

The end face 54 of the staple driver 16 facing the material 18 to be stapled is provided with a groove 56 for the yoke of a wire staple 11.

At its front end facing the material 18 to be stapled, the staple holder 14 has two side cheeks 60, 62 which are provided at their sides facing one another with guide grooves 64, 66 for accommodating the two legs of the wire staple 11.

A staple former 67 provided with a retaining slot 66 running transversely to the stroke direction is provided for bending the wire staple 11, which staple former 67 is guided in the stapling head frame 12 in such a way as to be displaceable into the path of staple holder 14 and staple driver 16 between the side cheeks 60, 62.

Figure 2:
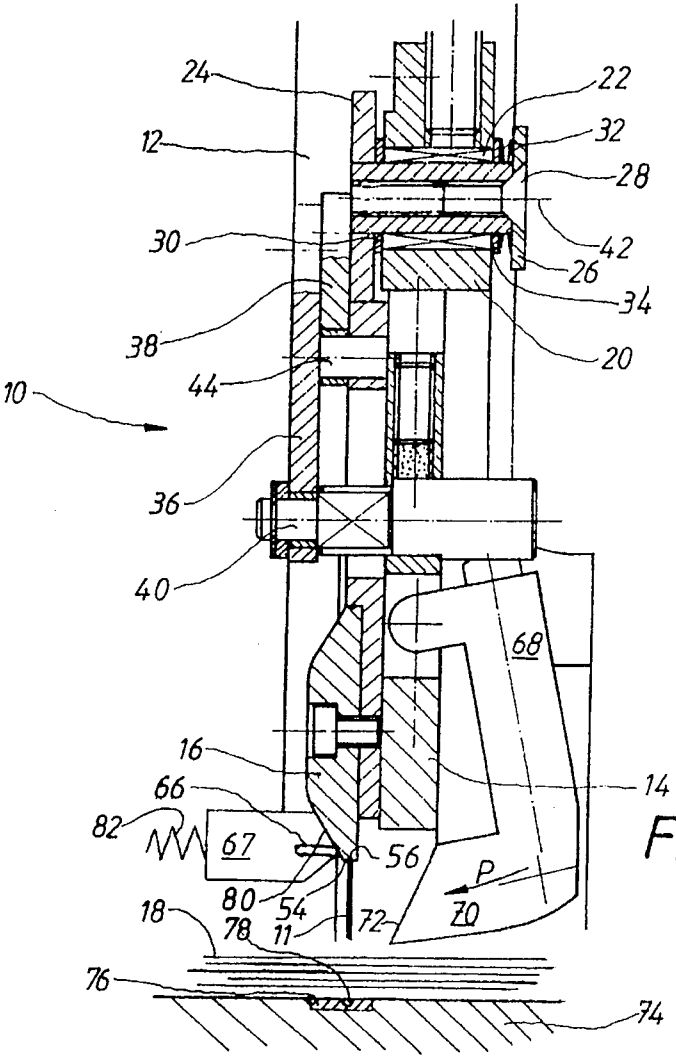
FIG. 2 shows a side view of the stapling head shown in FIG. 1.

Pivotably fastened to the staple holder 14 is a staple support 68, the head 70 of which is pressed by means of a spring (not shown) in the direction of arrow P into the path of the staple driver 16 in front of its end face and between the side cheeks 60, 62 of the staple holder 14. The head 70 of the staple support 68 has the width of the clear distance between the legs of the wire staple 11; it has a sloping surface 72. In FIG. 2, the staple support 68 is shown in the position swung out of the path of the staple driver 16.

Located opposite the end face 54 of the staple driver 16 is a paper rest 74 having a stapling socket 76 or an equally acting device, which has two cup-shaped recesses 78 for bending over the legs of the wire staple 11 after the legs have penetrated the material 18 to be stapled.

The staple holder 14 and staple driver 16 are driven by means of a drive device (not shown) which acts on the sliding block 20 and causes the sliding block 20 to perform a stroke movement. This stroke movement is transmitted via the cam plate 24 and the two connecting rods 36, 38 to the staple holder 14 and the staple driver 16.

During the first phase of the working stroke, the side cheeks 60, 62 move laterally along the staple former 67 and in the process bend over the two laterally protruding ends of a wire section accommodated in the retaining slot 66 to form legs of a wire staple 11. As a result, the yoke of the wire staple 11 comes to lie in the groove 56 of the staple driver 16 and its two legs come to lie in the guide grooves 64, 65 in the side cheeks 60, 62 of the staple holder 14.

During the further movement, a sloping surface 80 of the staple driver 16 presses the staple former 67 against the force of a spring 82 out of its path and out of the path of the staple holder 14.

The head 70 of the staple support 68, which support is guided in its head area by means of guides (not shown) on the stapling head frame 12, then swings between the legs of the wire staple 11 so that the wire staple 11 is enclosed in the grooves 56, 64, 65 of the staple driver 16 and the staple holder 14.

During the first phase of the working stroke, the guide surface 46 of the cam plate 24 comes to bear on the guide rail 48 so that the cam plate 24 is supported in a rotationally locked manner against the guide rail 48; the staple driver 16 is fixed to the staple holder 14 via the two connecting rods 36, 38 and the cam plate 24 so that a relative movement between staple driver 16 and staple holder 14 is impossible; the staple driver 16 and the staple holder 14 move together during the first phase of the working stroke.

At the end of the first phase of the working stroke, the cam plate 24 clears the guide rail 48 and can therefore pivot during a subsequent second phase of the working stroke. At the start of the second phase of the working stroke, the staple holder 14 with the side cheeks 60, 62 comes down on the material 18 to be stapled and at the same time runs against a stop (not shown) at the stapling head frame 12; the movement of the staple holder 14 is thereby stopped. The sliding block 20 is driven further beyond this point in the direction of the material 18 to be stapled so that the cam plate 24 on the drive pin 22 moves further in the direction of the material to be stapled. The stopped staple holder 14 holds back the cam plate 24 via the holder connecting rod 36 at the location at which the holder connecting rod 36 acts. The cam plate 24 consequently performs a pivoting movement about its rotation axis 42 in the direction shown by arrow Q in FIG. 1. The staple driver 16 is driven further via the driver connecting rod 38 and in the process presses the head 70 of the staple support 68 at its sloping surface 72, which bears on an edge of the end face 54 of the staple driver 16, continuously out of its path. At the same time, the staple driver 16 drives the legs of the wire staple 11 through the material 18 to be stapled until its yoke bears on the material 18 to be stapled. The legs of the wire staple 11 are bent over in the cup-shaped recesses 78 of the stapling socket 76 and thereby staple together the material 18 to be stapled.

Since the head 70 of the staple support 68 is continuously pivoted out of the path of the staple driver 16 when the wire staple 11 is being driven in by the staple driver 16, the head 70, when the wire staple 11 is being driven in, is located in the area between the side cheeks 60, 62 of the staple holder 14 in which the legs of the wire staple 11 are also accommodated in the guide grooves 64, 65 of the side cheeks 60, 62. The legs of the wire staple 11 are thereby supported laterally in all directions provided they are still located in the guide grooves 64, 65. Over their remaining length which projects beyond the side cheeks 60, 62, the legs of the wire staple 11 are driven into and are thereby guided in the material 18 to be stapled. Undesirable distortion of the wire staple 11 when being driven into the material 18 to be stapled is thus virtually impossible.

After the staple holder 14 stops when it comes down on the material 18 to be stapled, the pivoting movement of the cam plate 24 is superimposed on the stroke movement of the cam plate 24, as a result of which the staple driver 16 is greatly accelerated. This brings about the desired effect that the wire staple 11 is knocked into the material 18 to be stapled. When the staple driver 16 has reached the material 18 to be stapled and the wire staple 11 has been driven in completely, the working stroke ends and the staple holder 14 as well as the staple driver 16, via the two connecting rods 36, 38 and the cam plate 24, are lifted with the sliding block 20 in an idle stroke from the material 18 to be stapled. During this idle stroke the lobe 52 of the cam plate 24 comes to bear on the restoring rail 50 and slides along the latter and in the process is pressed to the side, as a result of which the cam plate 24 is pivoted back into its initial position. Thus all parts of the stapling head 10 assume their initial position again at the end of the idle stroke.

We claim:

1. A stapling head operable during a working stroke to staple piled sheets of paper using wire staples, comprising:

a frame;

a staple holder guided in said frame and being displaceable in a working direction essentially perpendicular to the sheets of paper;

a staple driver guided on said staple holder and being displaceable in the working direction; and driving means for moving said staple holder and said staple driver in the working direction during a first phase of the working stroke so that said staple holder is moved onto the piled sheets, and is stopped at the piled sheets at an end of the first phase; for moving said staple driver further in the working direction to drive a wire staple out of said staple holder and into the piled sheets during a second phase of the working stroke; and for moving said staple driver and said staple holder back into their initial positions during an idle stroke, said driving means comprising:

a cam plate rotatably mounted in said frame, and being movable in the working direction;

a first connecting rod having one end eccentrically connected to said cam plate, and another end pivotally connected to said staple holder, and being moved by said cam plate in an eccentric direction relative to the working direction;

a second connecting rod having one end eccentrically connected to said cam plate, and another end pivotally connected to said staple driver, and being moved by said cam plate in an eccentric direction relative to the working direction; and guide means including a guide link attached to said frame for supporting and rotationally locking said cam plate to positionally fix said staple driver relative to said staple holder during the first phase, and unlocking said cam plate during the second phase so that said staple driver and said staple holder are not positionally fixed relative to each other.

2. The stapling head defined in claim 1, wherein said guide link comprises a stationary guide rail extending in the working direction; and wherein said guide means further includes a guide surface formed on a lateral side of said cam plate supported by said guide rail during the first phase, and clearing said guide rail during the second phase.

3. The stapling head defined in claim 2, further comprising a restoring rail attached to said frame; said cam plate engaging said restoring rail during the idle stroke to pivot said cam plate into an initial angular position in which said guide surface is essentially parallel to said guide rail.

4. The stapling head defined in claim 1, further comprising a drive pin having said cam plate rotationally mounted thereon and being drivable in the working direction, said drive pin having an axis perpendicular to the working direction.

5. The stapling head defined in claim 1, further comprising means for bending a wire section to form a U-shaped wire staple, including:

a staple former located in a region of the piled sheets, and having a retaining slot extending perpendicular to the working direction for accommodating the wire section so that a respective end of the wire section laterally protrudes from each end of the retaining slot; and said staple holder, wherein said staple holder has a front end facing the piled sheets, and two side cheeks in a region of said front end each extending along a lateral side of said staple former during the first phase to engage with the laterally protruding ends of the wire section to form legs of the U-shaped wire staple.

6. The stapling head defined in claim 5, wherein each side cheek includes a guide groove for accommodating the legs of the wire staple.

7. The stapling head defined in claim 5, wherein said staple driver has an end with a sloping surface facing the piled sheets and being engageable with said staple former during the working stroke to move said staple former out of a path of said staple driver.

8. The stapling head defined in claim 5, further comprising a staple support locatable between said side cheeks of said staple holder in an area of the legs of the wire staple.

9. The stapling head defined in claim 8, wherein said staple support includes a sloping surface engageable by said staple driver during the second phase to move said staple support out of a path of said staple driver.

10. The stapling head defined in claim 1, further comprising a rotary brake engageable with said cam plate for preventing inadvertent rotation of said cam plate.

* * * * *